US005632125A

United States Patent [19]

Osanai

[11] Patent Number: 5,632,125

[45] Date of Patent: May 27, 1997

[54] CURTAIN WALL

[75] Inventor: Masami Osanai, Funabashi, Japan

[73] Assignee: YKK Architectural Products Inc., Tokyo, Japan

[21] Appl. No.: 425,803

[22] Filed: Apr. 20, 1995

[30] Foreign Application Priority Data

Apr. 21, 1994 [JP] Japan ..... 6-083350

[51] Int. Cl.[6] ..... E04B 2/88

[52] U.S. Cl. ..... 52/235; 52/483.1; 52/460; 52/774; 52/730.3

[58] Field of Search ..... 52/775, 774, 772, 52/764, 235, 730.3–730.5, 460, 464, 468, 483.1

[56] References Cited

U.S. PATENT DOCUMENTS

| | | | |
|---|---|---|---|
| 3,434,258 | 3/1969 | Leurent | 52/772 X |
| 3,798,862 | 3/1974 | Stoakes | 52/235 X |
| 4,117,640 | 10/1978 | Vanderstar | 52/775 X |
| 4,428,171 | 1/1984 | Harbin | 52/772 X |
| 4,648,231 | 3/1987 | Laroche | 52/468 X |
| 4,680,905 | 7/1987 | Rockar | 52/464 X |
| 4,707,959 | 11/1987 | Stoakes | 52/775 X |
| 4,766,709 | 8/1988 | Galbraith | 52/730.4 X |
| 4,996,809 | 3/1991 | Beard | 52/235 X |
| 5,369,924 | 12/1994 | Neudorf | 52/235 |

FOREIGN PATENT DOCUMENTS

| | | | |
|---|---|---|---|
| 2387575 | 11/1978 | France | 52/730.5 |
| 2545491 | 5/1976 | Germany | 52/730.5 |

*Primary Examiner*—Robert Canfield

*Attorney, Agent, or Firm*—Finnegan, Henderson, Farabow, Garrett & Dunner, L.L.P.

[57] ABSTRACT

A curtain wall 2 in which attachment portions 12, 13 are arranged near an interior surface 11A and an exterior surface 11B to form mullions 10 and transoms 30 as structural member, and toward the attachment portions 12, 13, a supporting member 15 supporting a glass panel 4 and a facing member 14 covering the interior surface 11A are attached.

14 Claims, 7 Drawing Sheets

CURTAIN WALL

BACKGROUND OF THE INVENTION

1. Field of the Invention

The present invention relates to a curtain wall used as to be an outer wall defining an architectural structure such as building.

2. Description of the Related Art

The curtain wall is generally provided to secure mullions (vertical members) to building frames supporting upper and lower floors in an architectural structure, to cross traverse members such as transoms between these mullions, and to arrange surface members selected from glass plate, aluminum plate, concrete plate, stone plates and so on at respective openings divided by these mullions and traverse members By the way, for modem buildings and so on, it has been required to have fertile de sign, so that the surface of the outer wall or curtain wall is deliberately improved to show fertile appearance.

There have been known in the art several types of curtain walls, for example, the first one being structured to conspicuously project mullion outside over a surface member such as glass board, the second one being provided to generally align respective surface levels both of the mullions and the traverse members with that of the surface member, the third one having a feature to sectionally show uneven surface arrangement with plural surface members which are alternatively rise and fall inside or outside, the fourth one being characterized to arrange one of mullions and traverse members inside of surface members not to expose it outside in order to emphasize an adjusted alignment thereof in a traverse or vertical direction, the fifth one being provided not to expose outside both of mullions and traverse members but to arrange them inside of the surface members, and the sixth one having two or more surface members laminated on one on the other to achieve effective heat and sound insulating properties.

However, the mullions and traverse members are generally made into different shapes respectively in conformity with types of curtain walls and each curtain wall further requires exclusive mullions and traverse members having different shape and structure, so that it has been inevitable to prepare several kinds of mullions and traverse members upon each conventional curtain wall.

Accordingly, the user might suffer from administration (production, stock, shipment, and so on) of producing molds and produced mullions and traverse members.

In order to overcome the above-mentioned disadvantages, the Japanese Patent Publication No. Sho 55-1423 and the Japanese Utility-model Publication No. Sho 55-571 taught to use only one kind of mullion to install various kinds of curtain walls.

In particular, the mullion suggested in the Japanese Patent Publication No. Sho 55-1423 is provided to support vertically aligned walls (vertical walls) from both sides of its base portion having square section and to keep corresponding horizontal walls extending perpendicularly from forward ends of the vertical walls to form coupling grooves into which window glasses will be attached, hence various curtain walls called flat-type, convexoconcave-type or double-glass type can be obtained.

The mullion taught in the Japanese Utility-model Publication No. Sho 55-571 consists of two mullion half-members vertically separated each of which is provided with grooves at its eccentric portions to carry window glasses therein to thereby obtain various curtain walls called flat-type or convexoconcave-type in a state that the mullions are projected outwardly.

However, it has been pointed out that the former type can not be applied to shade mullions inside of the room and the latter type can not use the double window glasses and put mullions inside of the room. As a result, the conventionally proposed mullions were limitedly utilized in about three types of the curtain walls but it could not be applied into all seven types of curtain walls, so that it was still required to prepare various kinds of mullions and horizontal members to assemble any kind of curtain walls.

Accordingly, the present invention is conceived to provide a curtain wall of which concept can be applied into various kinds of curtain walls each showing a different external surface by using mullions and horizontal members having a single standardized structure to minimize kinds of necessary mullions and horizontal members and to make administration easy in terms of production, stock and shipment and in terms of molds for producing them.

SUMMARY OF THE INVENTION

A curtain wall, according to the present invention, is characterized to comprise: a structural member having a base portion, attachment portions including a pair of engagement sections both at interior and exterior surfaces of the base portion, the structural member being used as mullion and horizontal member intersecting to each other so as to divide a building wall into several openings; face-plate supporting means attached to at least one attachment portion at interior or exterior side of the structural member; and a face-plate supported by the face-plate supporting means.

Accordingly, when emphasizing the mullion and the horizontal member outwardly upon design, the face-plate supporting means should be attached to the attachment portion on the interior side of the structural member with keeping therein a face plate. While, if required to maintain a flash surface of the mullion, horizontal member and the face-plate, the face-plate supporting means should be attached on the attachment portion on the exterior side of the structural member.

When obtaining a double-glass curtain wall and alternatively rising and falling inside or outside curtain wall surface, the face-plate supporting means are attached to the respective attachment portions on the interior and exterior sides of the structural member.

The base portion of the structural member is provided with an attachment portion having a pair of engagement sections on the interior and exterior sides. The facing member covering the face-plate supporting means supporting the face-plate at the attachment portion or the attachment portion can be selectively applied.

DETAILED DESCRIPTION OF THE PREFERRED EMBODIMENT(S)

The most preferable embodiment in accordance with the present invention will hereunder be described with reference to the attached drawings.

Figure 1:
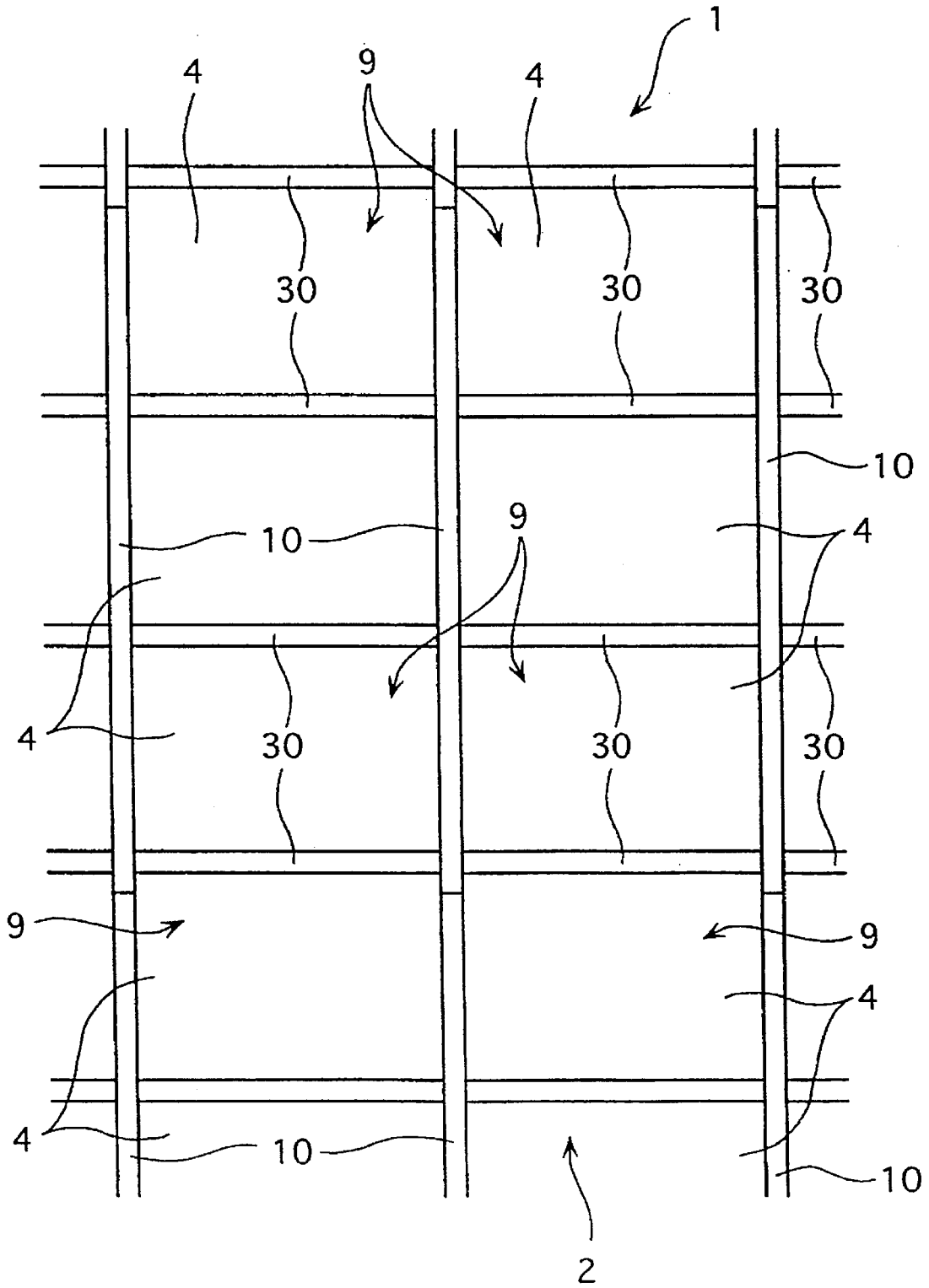
FIG. 1 is a view of wall surface of a building using curtain walls of the first embodiment in accordance with the present invention.

FIG. 1 is of an elevational view of wall surface composing an architectural structure 1, the wall consisting of plural curtain walls 2 employing structural materials for curtain wall of the preferred embodiment in accordance with the present invention. As can be seen from FIGS. 2 and 3 in conjunction with FIG. 1, between building frames 3 supporting upper and lower floors in the architectural structure 1, there are provided securely mullions 10 as structural material and horizontal members 30 are further extended laterally and connected between these mullions 10 to divide the wall into several openings 9. The divided openings 9 are respectively covered thereon with glass panels 4 as face-plate for curtain wall to thereby assemble the curtain wall 2 according to the embodiment.

Figure 2:
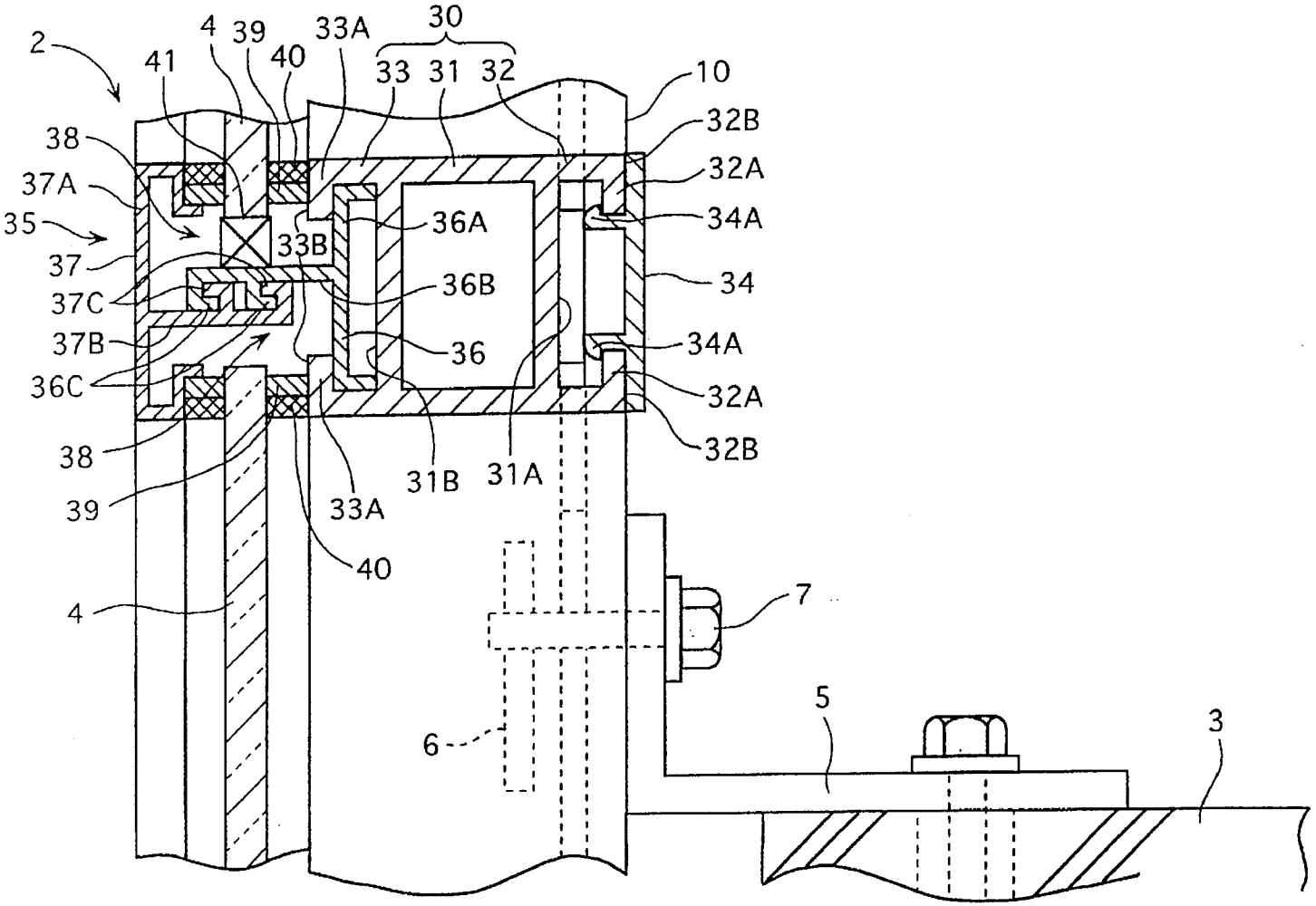
FIG. 2 is a vertical section view of the curtain wall composed of a mullion and horizontal member as structural member in the first embodiment.
Figure 3:
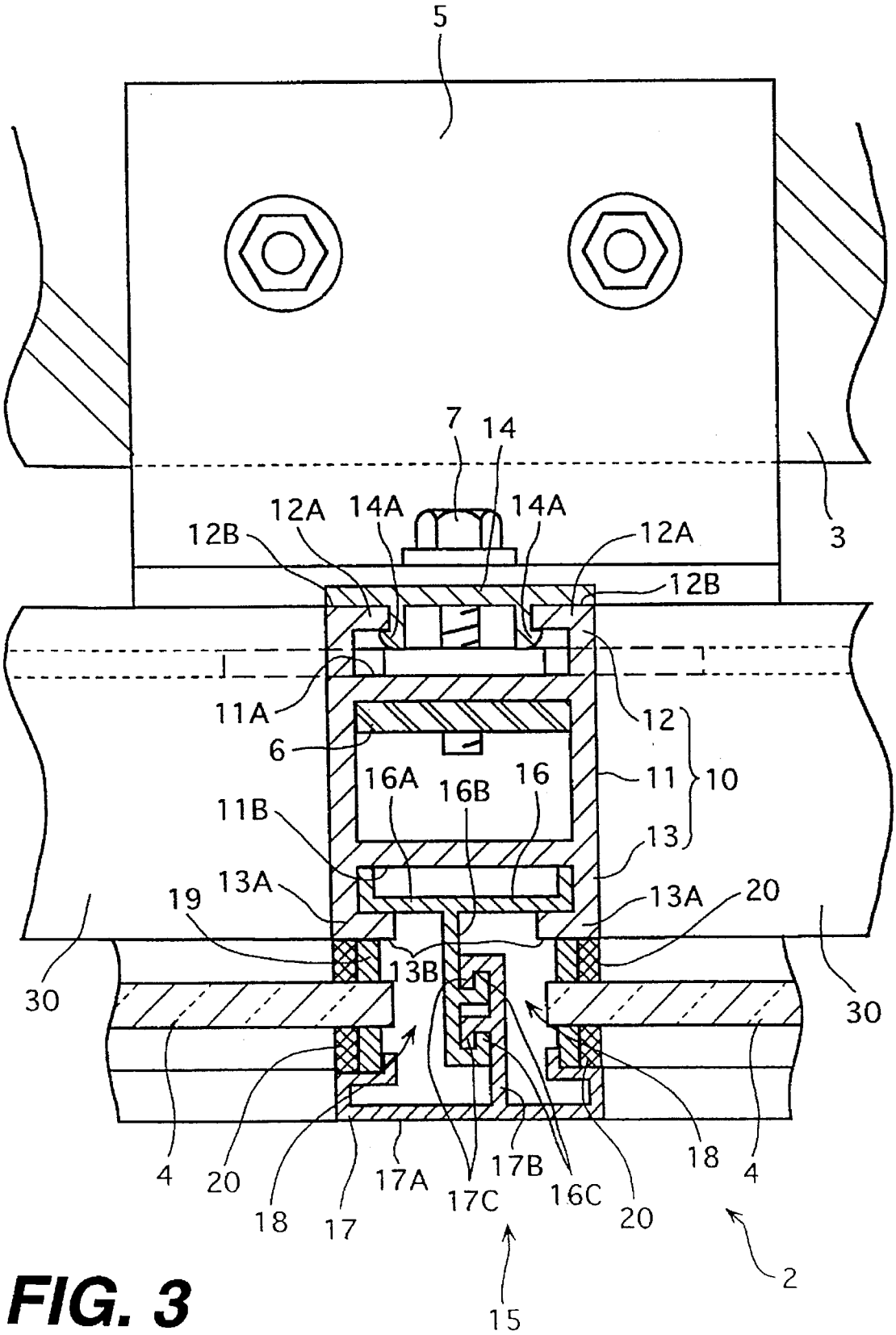
FIG. 3 is a horizontal section view of the curtain wall.

As shown in FIGS. 2 and 3, a bracket 5 is screwed on the building frame 3 by means of bolts to attach the mullion 10 on the bracket 5 by driving a bolt 7 tightly into a double plate 6 secured inside of the mullion 10.

The horizontal member 30 is connected with the mullions 10 at its both ends in association with a cross-shaped connection plate 8 provided to reinforce joining state between the mullion and the horizontal member.

The configuration both of the mullion 10 and the horizontal member 30 is almost similar to the character "II" in section as shown in FIGS. 2 and 3, that is, which comprises square-shaped base portion 11, 31 located in center and attachment portions 12, 13, 32, 33 each having a pair of engagement sections 12A, 13A, 32A, 33A providing receiving surfaces 12B, 13B, 32B, 33B facing toward the inside or outside of the room. Incidentally, such mullion and horizontal member is made from aluminum and can be produced in a single extrusion molding (showing same sectional shape at any position in its longitudinal direction).

Each of the respective engagement sections 12A, 13A, 32A, 33A of the attachment portions 12, 13, 32, 33 is extended toward inside or outside of the room perpendicularly to the longitudinal direction of the mullion 10 or the horizontal member 30 with certain intervals therebetween in the horizontal or vertical direction along the wall surface to have a sectionally L-shaped configuration.

The attachment portion 12, 32, which is provided near an interior surface 11A, 31A of the mullion 10 or the horizontal member 30 in a state so as to face toward the room, is coupled with a facing member 14, 34 at its receiving surface 12B, 32B. The facing member 14, 34 is made from preferable material such as aluminum or plastic upon design and is provided integrally with an engagement member 14A, 34A which is adapted to couple into the engagement section 12A, 32A of the attachment portion 12, 32.

The attachment portion 13, 33 near an exterior surface 11B, 31B of the mullion 10 or the horizontal member 30 is adapted to receive therein a supporting member 15, 35 as face-plate supporting means to carry the glass panel 4.

The supporting member 15, 35 consists of a base portion 16, 36 interlocked in the attachment portion 13, 33 and a front portion 17, 37 connected to the base portion 16, 36.

The base portion 16, 36 is composed of a mount plate 16A, 36A and a connecting plate 16B, 36B made by an injection molding and the like integrally using aluminum so as to show a T-shaped section and it has a length equal to that of the mullion 10 or the horizontal member 30. Incidentally, the base portions 16 and 36 should be understood to be the same member.

The mount plate 16A, 36A relates to the attachment portion 13, 33 of the mullion 10 or the horizontal member 30 not to rattle in the interior and exterior directions by means of the engagement section 13A, 33A.

Therefore, an application of the base portion 16, 36 can be carded out by inserting the mount plate 16A, 36A into the attachment portion 13, 33 from one end of the mullion 10 or the horizontal member 30. If necessary to fix the base portion 16, 36 at a certain place with reference to the mullion 10 or the horizontal member 30, it can be achieved by using some screws.

The connecting plate 16B, 36B is formed integrally with an engagement section 16C, 36C along its entire length.

The front portion 17, 37 is made by an injection molding and the like using aluminum and is formed into a sectionally T-shaped configuration with a front plate 17A, 37A and a connection plate 17B, 37B. The length of the front portion 17, 37 should be considered to have the same length as that of the mullion 10 or the horizontal member 30.

The connecting plate 17B, 37B is provided integrally with a sectionally L-shaped engagement section 17C, 37C which relates to the engagement section 16C, 36C and has a length equal to that of the connecting plate 17B, 37B.

As has been described above, the supporting member 15, 35 shows a sectionally H-shaped configuration by means of the engagement section 16C, 36C and the engagement section 17C, 37C of the base portion 16, 36 and the front portion 17, 37 in an engagement state to form a recess grove 18, 38 along an entire length of the supporting member 15, 35.

The recess groove 18, 38 should be considered to receive therein one end of the square glass panel 4 via a sealing member 20, 40 such as a back-up member 19, 39 or an elastic sealant arranged in a contacting state with the receiving surface 13B, 33B of the engagement section 13A, 33A and front portion 17, 37. Incidentally, on the supporting member 35 attached to the exterior surface 31B of the horizontal member 30, there is arranged a setting block 41 to put thereon the glass panel 7.

Figure 5A:
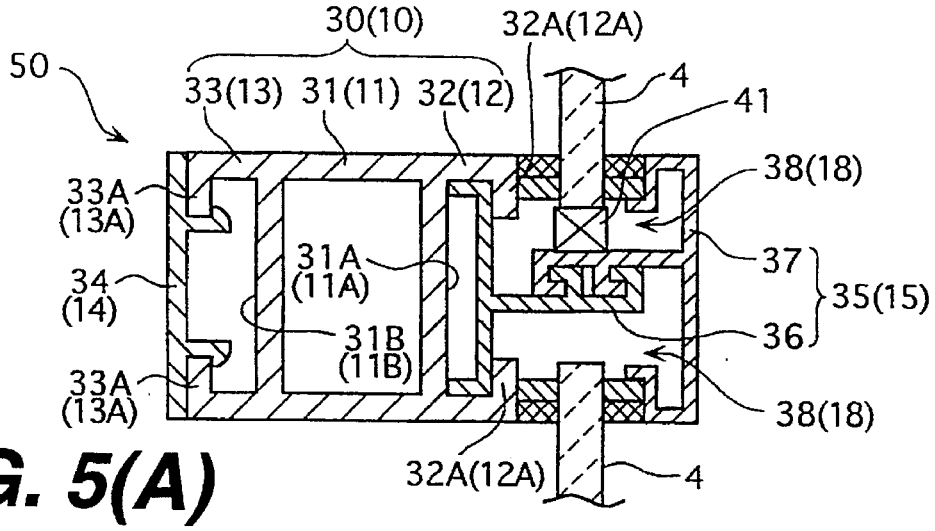
FIGS. 5(A), 5(B) and 5(C) are sectional views of other type curtain walls employing the same structural member in the first embodiment.
Figure 5B:
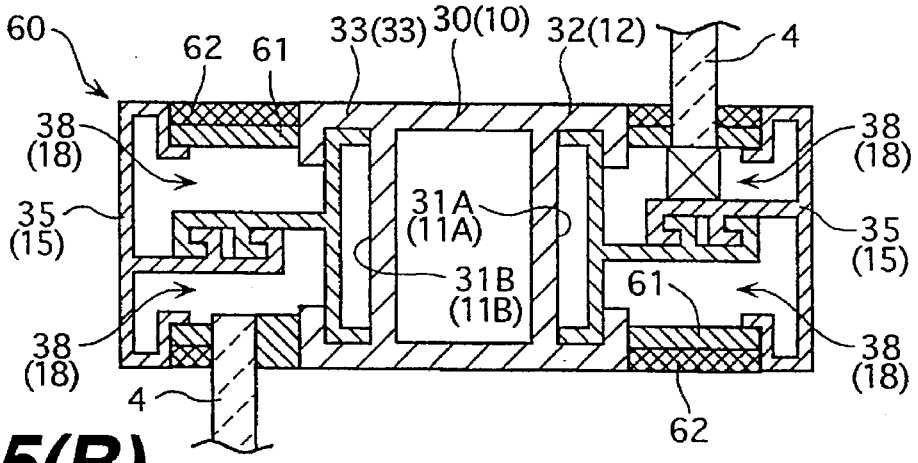
Figure 5C:
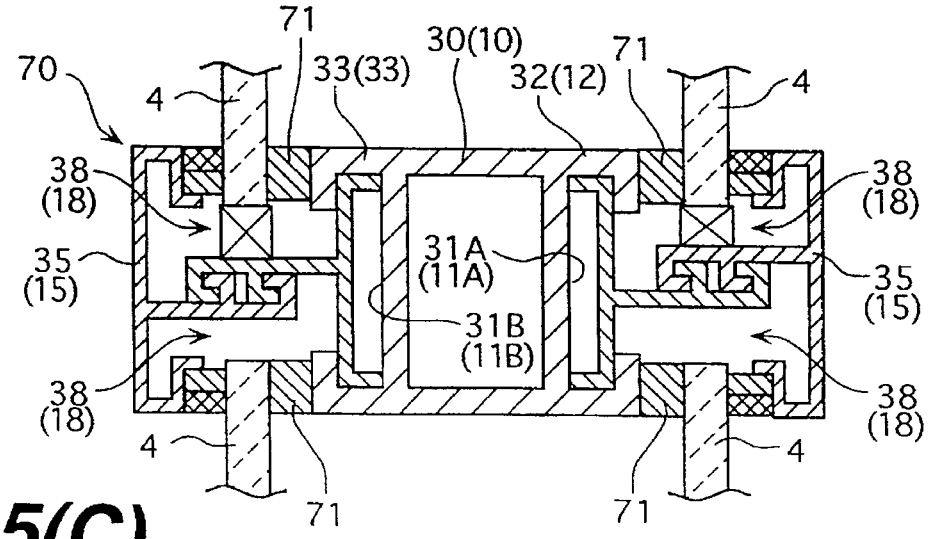

The afore-described mullion 10 and the horizontal member 30 can be applied to other types of curtain walls which will be explained hereinafter. FIGS. 5(A), 5(B) and 5(C) are attached to show an vertical section of the horizontal member 30 but the mullion 10 (described in a set of brackets) should be considered as have the similar organization except for the setting block 41 when the sectional view thereof will be described.

Another application of the present invention is shown in FIG. 5(A) in which the supporting member 15, 35 is attached to the attachment portion 12, 32 near the interior surface 11A, 31A of the mullion 10 or the horizontal member 30 while the facing member 14, 34 is attached at the attachment portion 13, 33 of the exterior surface 11B, 31B. Accordingly, the glass panel 4 is arranged to be received in the recess groove 18, 38 of the attachment portion 12, 32 so that a differently designed curtain wall 50 by which the mullion 10 and the horizontal member 30 are arranged outside remarkably in relation to the surface of the glass panel 4 will be obtained.

FIG. 5(B) shows still another application according to the present invention, and particularly that the supporting members 15 and 35 are oppositely attached to the attachment portion 12, 32 near the interior surface 11A, 31A and also to the attachment portion 13, 33 near the exterior surface 11B, 31B of the mullion 10 and the horizontal member 30. The glass panels 4 are arranged at one of the two recess grooves 18, 38 of the supporting member 15, 35 inside the room and at the other of the two opposite recess groove 18, 38 of the supporting member 15, 35 outside the room. The remaining recess groove 18, 38 without the glass panel 4 is covered with the back-up member 61 and the sealing member 62.

Accordingly, the curtain wall 60 as shown in FIG. 5(B) is therefore composed of the forward and backward glass panels 4 as an external appearance of the wall.

FIG. 5(C) further presents another application of the present invention, particularly that the supporting members 15, 35 are attached to the attachment portion 12, 32 near the interior surface 11A, 31A and also to the attachment portion 13, 33 of the exterior surface 11B, 31B of the mullion 10 or the horizontal member 30. The glass panels 4 are securely inserted both recess grooves 18, 38 of the inner and outer supporting members 15, 35 as shown to form a double-glass curtain wall 70 having an airtight portion between two glass panels which effects a heat and sound insulation. Incidentally, the sealing between the respective glass panels 4 after composing such double-glass state may be difficult, so that it is recommended to apply some preferable sealing member 71 such as an air-tight rubber before assembling such double-glass curtain wall.

Figure 6A:
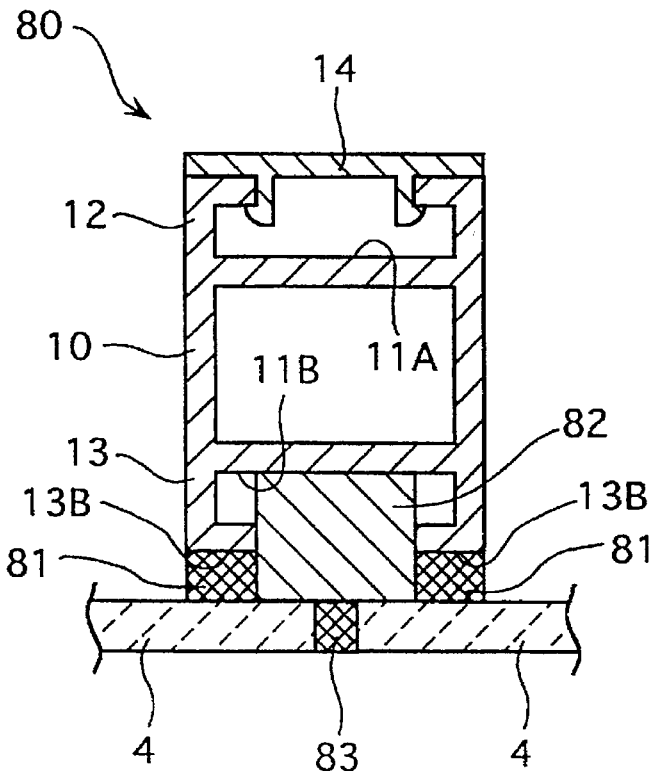
FIG. 6(A) and 6(B) are sectional views of other curtain walls not to expose the mullion or the horizontal member outside.

In FIG. 6(A), there is shown a still another application in accordance with the present invention. Actually, the facing member 14 is coupled into the attachment portion 12 near the interior surface 11A of the mullion 10, a structural sealant 81 such as silicon rubber as the face-plate supporting means is applied at the receiving surface 13B of the attachment portion 13 near the exterior surface 11B of the mullion 10 and the back-up member 82 is inserted between these structural sealants 81. The structural sealant 81 naturally involves an adhesive force to support back surface of the glass panel 4 longitudinally to thereby assemble a curtain wall 80 capable of putting the mullion 10 out of sight. Incidentally, between the glass panels 4 there should be provided a sealing member 83.

Figure 6B:
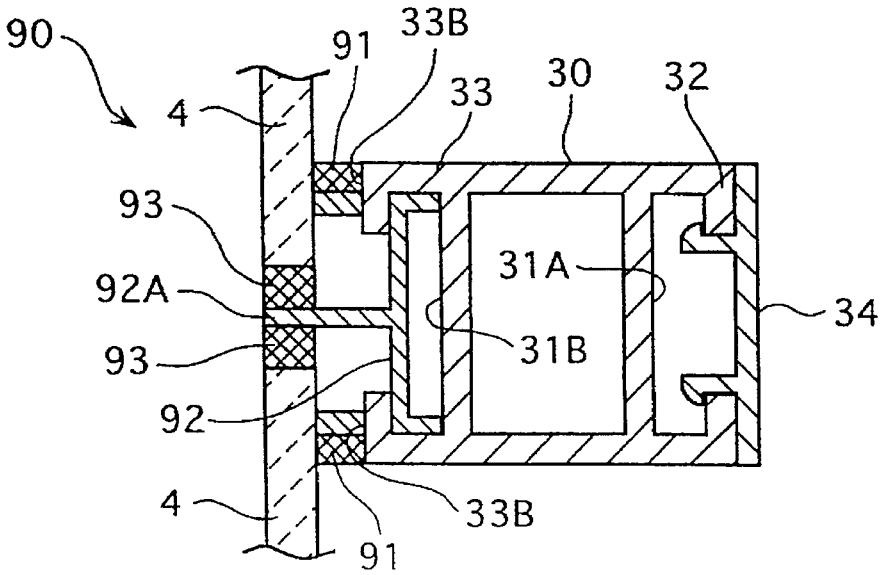

As shown in FIG. 6(B), the facing member 34 is coupled into the attachment portion 32 near the interior surface 31A of the horizontal member 30 while the structural sealant 91 as face-plate supporting means and the long supporting member 92 having a sectional T-shape are attached to the attachment portion 33 near the exterior surface 31B of the horizontal member. The glass panels 4 are secured via sealing members 93 over and below a supporting plate portion 92A extending horizontally from the supporting member 92. Incidentally, there is provided between the glass panel 4 and the receiving surface 33B the structural sealant 91 of which adhesive force effect to support upper and lower edges of the glass panel 4 to thereby obtain a curtain wall 90 which hides the horizontal member 30 from view.

However, the curtain walls 80, 90 shown in FIGS. 6(A) and 6(B) are also available to be modified as described in FIGS. 2 and 3 so as to carry the glass panels 4 by the supporting members 15, 35 with reference to the mullion 10 and the horizontal member 30 or as shown in FIG. 6 such that they can be arranged to keep the mullion 10 and the horizontal member 30 out of sight.

Accordingly, whenever assembling the above-proposed various curtain walls 2, 50, 60, 70, 80, 90, the same mullions 10 and the horizontal members 30 as structural material can be used commonly in association with the supporting member 15, 35 as the face-plate supporting means, the structural sealant 81, 91, the facing member 14, 34 and so on. It is therefore available to reduce the type of the mullion 10 and the horizontal member 30 to a minimize (or into one type having the same section) to thereby improve productivity of the mullion 10 and the horizontal member 30 and reduce production cost.

Furthermore, both the supporting member 15, 35 and the facing member 14, 34 can be made into one common shape in section, so that the productivity can be improved and the production cost can be reduced.

Since the mullion 10 and the horizontal member 30 are generalized such as mentioned before, the members for composing curtain wall are decreased in number, which limits sorts of molds, so that an inventory control in factory and transportation control to site can be grasped easily and the management cost may be reduced.

As a result of such low cost, variously designed curtain wall can be provided at relatively low cost.

As mentioned before, while the conventional mullion is only allowed to be applied into three types of curtain walls, the mullion 10 and the horizontal member 30 are adapted to receive, at the engagement section 12A, 13A, 32A, 33A, the supporting member 15, 35, the structural sealant 81, 91 and the facing member 14, 34, so that 7 kinds of curtain wall of which glass panel 4 effects to take the curtain wall 2, 50, 60, 70, 80 and 90, the mullion 10 and the horizontal member 30 out of sight and the number of articles can be deminished.

As mentioned before, the horizontal section of the attachment portion 12, 13, 32, 33 is composed of the engagement section 12A, 13A, 32A, 33A having a horizontally L-shaped section, so that the supporting member 15, 35 can be attached such that the end of the core portion 16, 36 is inserted into the engagement section 12A, 13A, 32A and 33A and thereafter the member is fixed by means of set screws and the facing member 14, 34 can be attached to the engagement section 12A, 13A, 32A, 33A at the engagement member 14A, 34A, which contributes an improvement of workability.

Figure 7:
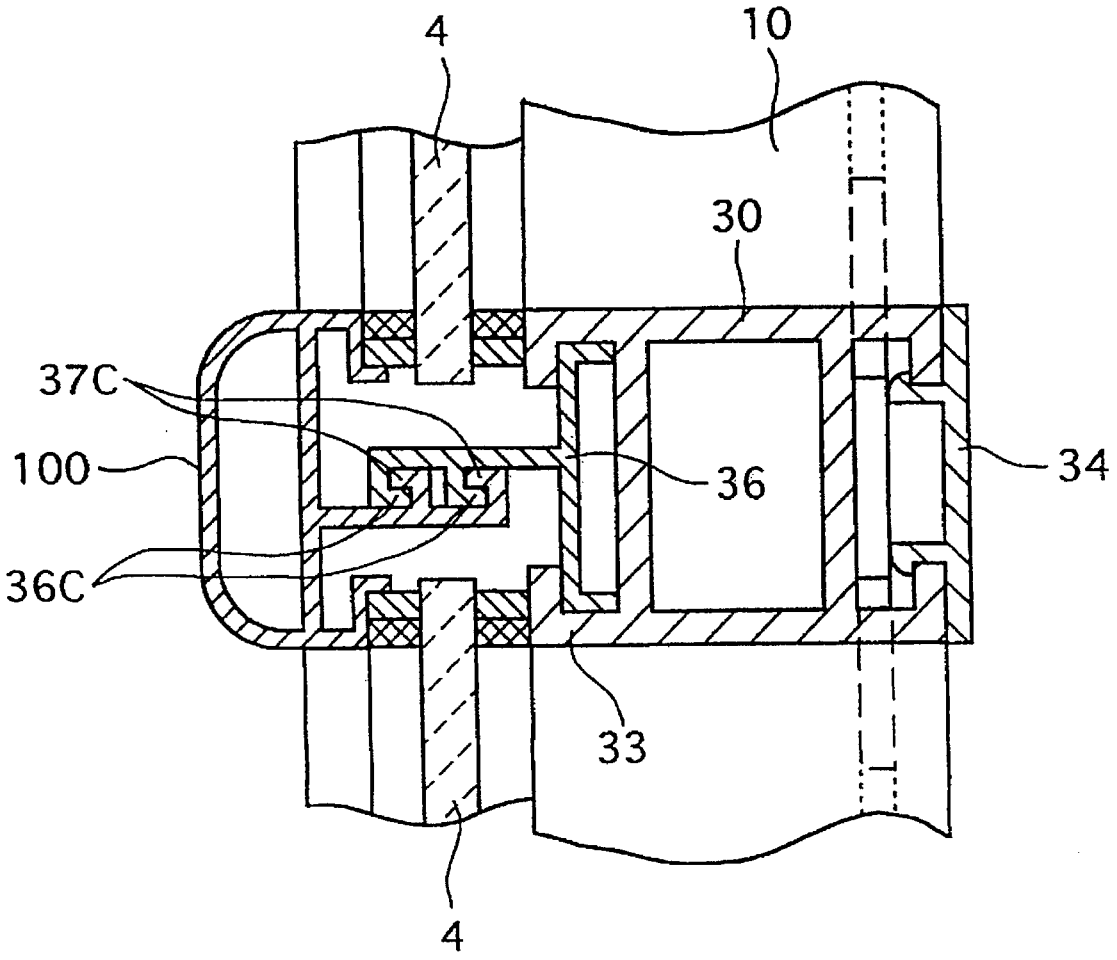
FIG. 7 is a vertical section view showing a modification in accordance with the present invention.

Since the supporting member 15, 35 consists of the core portion 16, 36 and the front portion 17, 37, the external appearance of the mullion 10 and the horizontal member 30 can be modified upon necessity. Taking for an instance, as shown in FIG. 7, as the front portion 17, 37 is replaced with the front portion 100 having a bent shape, the mullion 10 and horizontal member 30 showing different design can be obtained. However, it will not be required to change the core portion 16, 36 and the attachment work between the core portion 16, 36 and the front portion 17, 37, 100 can be completed by means of the engagement section 16C, 36C, 17C, 37C, so that the alternation of the front portion 17, 37, 100 after assembling the curtain wall to obtain a deferent design.

By the way, it should not be considered that the present invention is limited into the above-mentioned embodiments but the shape of the mullion and horizontal member as structural material may be changed such that the base portion 11, 31 is cylindrically shaped or may be designed upon necessity. The material of structural material is not only aluminum but also steel. When using steel, the base portion is made into a square column and a rip channel steel as the attachment portion is secured by welding or bolt.

The attachment portion may be partially provided every certain interval along the mullion 10 and the horizontal member 30. The attachment portion can be replaced with a screw if it will be able to secure the facing member 14, 34 and the supporting member 15, 35.

The shape of the engagement section of the attachment portion is not only limited into the L-shape as mentioned above but it can be modified into a T-shape as far as the face-plate supporting means and the facing member can be attached as expected.

The supporting member can be produced integrally in molding such that its sectional shape maintains the H-shape or as far as the glass panel 4 as the face-plate will be received. The connection between the base portion 16, 36 and the front portion 17, 37 to be the supporting member may be done by bolts. However, as naturally understood, the already explained structure by means of the engagement section 16C, 17C, 36C, 37C shall be proper in the connecting and disconnecting procedure.

The above-explained receiving surface provided on the engagement section can be omitted when the supporting member is provided with a preferable receiving surface to put the back-up member 19, 39 and the sealing member 20, 40 thereon. The configuration of the facing member should not be considered limitedly but it can be modified upon total design.

Figure 4:
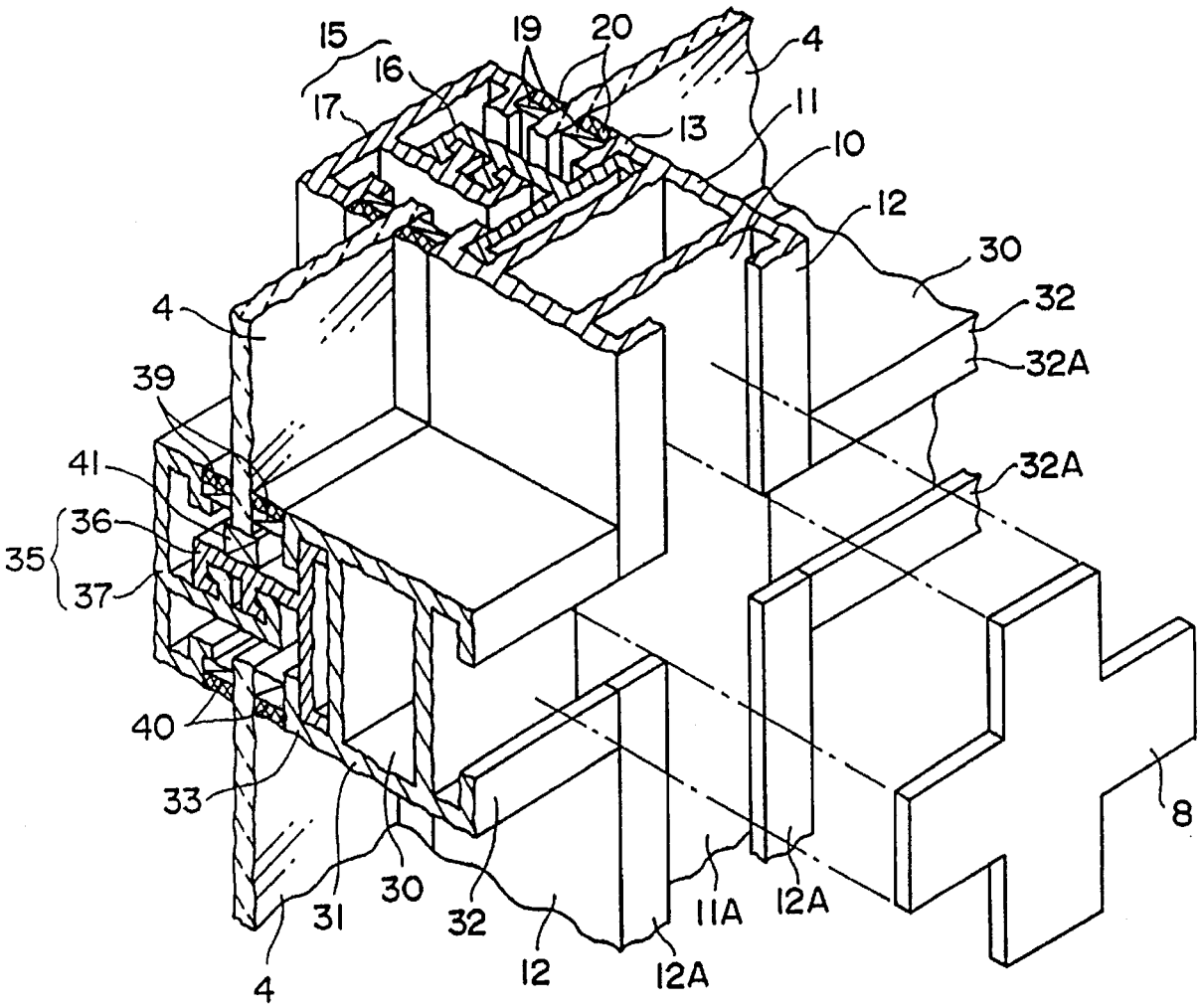
FIG. 4 is a perspective view showing connecting state between the mullions and the horizontal members.

FIG. 4 showed one preferable connecting method between the mullion 10 and the horizontal member 30. But it may be available to provide a connecting plate at a forward end of the horizontal member 30 to secure the mullion 10 to the plate by means of bolts.

Referring to the face-plate supporting means, one of face plates arranged side by side may be held in the recess groove 18, 38 via the back-up member and the sealing member as in the supporting member 15, 35 and the other may be supported by the sealing member 81, 91. Such a modification will be effective when applying a partially different design on the wall. It will be also available to keep the face-plate on one side and the facing member will be provided on the other side.

According to the present invention, any type of curtain wall can be formed by the structurally common mullion and horizontal member as structural material, which will surely reduce number of kinds of structural materials and accessories thereof and improve productivity, so that an administration in terms of production, stock and shipment and in terms of molds for producing them can be made simply.

As the opening portion in building is structured by the mullions and the horizontal members which are structurally same, a partially different wall in design can be easily assembled by utilizing the face-plate supporting means.

What is claimed is:

1. A curtain wall, comprising:

a plurality of structural members interconnected to form a plurality of openings, each structural member including a base portion having an interior surface and an exterior surface, a pair of interior attachment portions extending from the interior surface of the base portion and a pair of exterior attachment portions extending from the exterior surface of the base portion, each interior and exterior attachment portion including an engagement section, each structural member being adapted to support a face plate at each of said interior and exterior attachment portions; and a plurality of face plates positioned into the plurality of openings; and a plurality of face plate supporting means, each face plate supporting means being attached to at least one of (a) the interior attachment portions to support one of said plurality of face plates in an interior position, and (b) the exterior attachment portions to support one of said plurality of face plates in an exterior position.

2. A curtain wall as claimed in claim 1, further comprising a plurality of facing members attached to at least one of the interior attachment portions and the exterior attachment portions.

3. A curtain wall as claimed in claim 2, wherein one of said plurality of facing members is attached to the interior attachment portions of a structural member on which one of said plurality of face plate supporting means is attached to the exterior attachment portion and on which one of said plurality of facing members is attached to the exterior attachment portions of a structural member on which one of said plurality of face plates supporting means is attached to the interior attachment portion.

4. A curtain wall as claimed in claim 1, wherein the plurality of face plates are attached in alternating exterior and interior positions.

5. A curtain wall as claimed in claim 1, wherein said plurality of structural members comprise a plurality of mullions and a plurality of horizontal members interconnected by connecting plates.

6. A curtain wall as claimed in claim 1, wherein the engagement section of each exterior attachment portion includes an exterior receiving surface facing outwardly away from the exterior surface of the base portion and the engagement section of each interior attachment portion includes an interior receiving surface facing inwardly away from the interior surface of the base portion.

7. A curtain wall as claimed in claim 1, wherein each exterior attachment portion includes an exterior attachment member having a first end and a second end, the first end of the exterior attachment member being attached to the exterior surface of the base portion, the exterior attachment member being positioned at the longitudinal edge of the structural member perpendicular to the exterior surface of the base portion and the exterior engagement section of each exterior attachment portions being positioned at the second end of the exterior attachment member extending perpendicular from the exterior attachment member towards the other exterior attachment member; and each interior attachment portion includes an interior attachment member having a first end and a second end, the first end of the interior attachment member being attached to the interior surface of the base portion, the interior attachment member being positioned at the longitudinal edge of the structural member perpendicular to the interior surface of the base portion and the interior engagement section of each interior attachment portion being positioned at the second end of each interior attachment member extending perpendicular from the interior attachment member towards the other interior attachment member.

8. A curtain wall as claimed in claim 6, wherein each said face plate supporting means comprises:

a face plate supporting means base portion interlockable with the interior attachment portions; and a front face plate supporting means portion having a face plate supporting means receiving surface;

wherein the face plate supporting means base portion interlocks with the interior attachment portions supporting one of said plurality of face plates between the face plate supporting means receiving surface and the interior receiving surface.

9. A curtain wall as claimed in claim 6, wherein each said face plate supporting means comprises:

a face plate supporting means base portion interlockable with the exterior attachment portions; and a front face plate supporting means portion having a face plate supporting means receiving surface;

wherein the face plate supporting means base portion interlocks with the exterior attachment portions supporting one of said plurality of face plates between the face plate supporting means receiving surface and the exterior receiving surface.

10. A curtain wall as claimed in claim 8 or 9, wherein the face plate supporting means base portion is separable from the front face plate supporting means portion.

11. A curtain wall as claimed in claim 10, wherein the face plate supporting means base portion includes a face plate supporting means base portion engagement section and the front face plate supporting means portion includes a front face plate supporting means portion engagement section interconnectable to the face plate supporting means base portion engagement section.

12. A curtain wall as claimed in claim 6, wherein said face plate supporting means comprises a structural sealant adherable to at least one of the exterior receiving surfaces and the interior receiving surfaces.

13. A curtain wall as claimed in claim 4, Wherein the plurality of face plates are attached in vertically alternating exterior and interior positions.

14. A curtain wall as claimed in claim 4, wherein the plurality of face plates are attached in horizontally alternating exterior and interior positions.

* * * * *